US005715566A

United States Patent [19]

Weaver et al.

[11] Patent Number: 5,715,566

[45] Date of Patent: Feb. 10, 1998

[54] CLEANING MACHINE WITH A DETACHABLE CLEANING MODULE

[75] Inventors: James M. Weaver, Grand Rapids; Giovanni Pino, Chester Hills; Marc D. Zuiderveen, Hudsonville; Steven Umbach, Grand Rapids; Douglas J. Medema, Belding, all of Mich.

[73] Assignee: Bissell Inc., Grand Rapids, Mich.

[21] Appl. No.: 658,753

[22] Filed: Jun. 5, 1996

Related U.S. Application Data

[63] Continuation-in-part of Ser. No. 362,553, Jan. 6, 1995, Pat. No. 5,524,321, which is a continuation-in-part of Ser. No. 17,652, Feb. 12, 1993, Pat. No. 5,309,600.

[51] Int. Cl.[6] ..... A47L 5/30

[52] U.S. Cl. ..... 15/320; 15/321; 15/327.5; 15/328

[58] Field of Search ..... 15/321, 320, 322, 15/328, 327.5

[56] References Cited

U.S. PATENT DOCUMENTS

| | | |
|---|---|---|
| Re. 32,257 | 10/1986 | Dyson . |
| D. 278,560 | 4/1985 | Wareham . |
| D. 307,657 | 5/1990 | Li . |
| 1,944,950 | 1/1934 | Riebel, Jr. . |
| 2,210,950 | 8/1940 | Replogle . |
| 2,293,722 | 8/1942 | Erickson . |
| 2,303,409 | 12/1942 | Taylor . |
| 2,348,861 | 5/1944 | Smellie . |
| 2,686,331 | 8/1954 | Humphrey . |
| 2,779,047 | 1/1957 | Osborn . |
| 2,854,686 | 10/1958 | Hansen . |
| 2,876,481 | 3/1959 | Gerber et al. . |
| 2,898,621 | 8/1959 | Vance . |
| 2,898,622 | 8/1959 | Hurd . |
| 3,020,577 | 2/1962 | Carabet . |
| 3,039,129 | 6/1962 | Belicka et al. . |
| 3,039,130 | 6/1962 | Belicka et al. . |
| 3,126,570 | 3/1964 | Green . |
| 3,284,834 | 11/1966 | Waters . |
| 3,310,828 | 3/1967 | Clark et al. . |
| 3,316,579 | 5/1967 | Smith . |

(List continued on next page.)

FOREIGN PATENT DOCUMENTS

| | | |
|---|---|---|
| 1523210 | 5/1968 | France . |
| 648771 | 8/1937 | Germany . |
| 52 073 557 A | 6/1977 | Japan . |
| 54 100 149 A | 8/1979 | Japan . |
| 1052161 | 12/1966 | United Kingdom . |
| 2254777 | 10/1992 | United Kingdom . |

OTHER PUBLICATIONS

Lindhaus U.S.A., "Lindhaus DP–5 Upright Carpet Vacuum," Jan. 1993.

VDTA News, "Lindhaus Opens North American Sales and Distribution Center," Jan. 1993.

Hoover Company, "Hoover Concept Two Self Propelled Cleaning System With Power Surge," Jan. 1987.

Unknown "Hako Minuteman's 14," 2–Motor Patriot Upright Vacuum, prior to Aug. 25, 1992.

Stein & Co. relating to SEBO Automatic X1 Vacuum, Sep. 1992.

*Primary Examiner*—Chris K. Moore

*Attorney, Agent, or Firm*—Rader, Fishman, Grauer & Mc Garry

[57] ABSTRACT

A multi-use cleaning machine capable of use as an upright machine or as a detachable cleaning module is disclosed. A detachable cleaning module is selectively mounted to the foot and support member of an upright machine. The cleaning module includes the motor, motor-driven fan, dirt receptacle, and hose. The machine may be operated as an upright cleaning machine or, alternatively, the module can be separated from the foot and support member and may be used independently of and at a great distance from the foot and support member for a wide variety of cleaning purposes. The machine may be a vacuum cleaning machine or a water extraction cleaning machine.

27 Claims, 14 Drawing Sheets

U.S. PATENT DOCUMENTS

| | | | |
|---|---|---|---|
| 3,509,590 | 5/1970 | Koshiyama . | |
| 3,758,914 | 9/1973 | Nupp et al. . | |
| 3,821,830 | 7/1974 | Sundheim . | |
| 3,869,265 | 3/1975 | Wolter et al. . | |
| 3,955,237 | 5/1976 | Chateauneuf et al. . | |
| 4,008,505 | 2/1977 | Clowers . | |
| 4,209,875 | 7/1980 | Pugh et al. . | |
| 4,249,280 | 2/1981 | Goodrich . | |
| 4,318,202 | 3/1982 | Holman . | |
| 4,393,536 | 7/1983 | Tapp . | |
| 4,421,964 | 12/1983 | Buchtel . | |
| 4,467,493 | 8/1984 | Buchtel . | |
| 4,519,113 | 5/1985 | Hipple . | |
| 4,545,089 | 10/1985 | Oxel . | |
| 4,558,484 | 12/1985 | Groth . | |
| 4,635,315 | 1/1987 | Kozak . | |
| 4,660,246 | 4/1987 | Duncan et al. . | |
| 4,662,026 | 5/1987 | Sumerau et al. . | |
| 4,665,582 | 5/1987 | Richmond et al. . | |
| 4,670,937 | 6/1987 | Sumerau et al. . | |
| 4,683,607 | 8/1987 | Lackner et al. . | |
| 4,763,382 | 8/1988 | Sumerau . | |
| 4,766,638 | 8/1988 | McDowell . | |
| 4,809,397 | 3/1989 | Jacobs et al. | 15/328 |
| 4,811,450 | 3/1989 | Steadings . | |
| 4,811,452 | 3/1989 | Sumerau . | |
| 4,941,231 | 7/1990 | Jarosak | 15/328 |
| 4,947,512 | 8/1990 | Lackner et al. . | |
| 4,955,106 | 9/1990 | Stein et al. . | |
| 4,959,885 | 10/1990 | Sovis et al. . | |
| 5,007,133 | 4/1991 | Lackner et al. . | |
| 5,054,157 | 10/1991 | Werner et al. . | |
| 5,086,536 | 2/1992 | Lackner et al. . | |
| 5,247,720 | 9/1993 | Sovis et al. . | |
| 5,287,591 | 2/1994 | Rench et al. | 15/328 |
| 5,309,600 | 5/1994 | Weaver et al. . | |
| 5,311,638 | 5/1994 | Furcron et al. . | |
| 5,406,673 | 4/1995 | Bradd et al. . | |
| 5,500,977 | 3/1996 | McAllise et al. . | |
| 5,524,321 | 6/1996 | Weaver et al. | 15/329 |
| 5,555,597 | 9/1996 | Berfield | 15/328 X |

CLEANING MACHINE WITH A DETACHABLE CLEANING MODULE

RELATED APPLICATION INFORMATION

This is a continuation-in-part of application Ser. No. 08/362,553, filed Jan. 6, 1995, now U.S. Pat. No. 5,524,321 issued Jun. 11, 1996, which is a continuation-in-part of application Ser. No. 08/017,652, filed Feb. 12, 1993, now U.S. Pat. No. 5,309,600 issued May 10, 1994.

BACKGROUND TO THE INVENTION

1. Field of the Invention

This invention relates to a multi-use cleaning machine and, more particularly, to a floor cleaner having a cleaning module which is detachably mounted to a power foot and support member.

2. Description of Related Art

Cleaning machines have typically been one of two different designs, either an upright cleaner or a canister cleaner, and such cleaning machines are typically either a vacuum cleaning machine or a water extraction cleaning machine. The upright cleaner typically comprises a cleaning foot upon which is pivotally mounted a handle. The various elements of the cleaning machine, i.e., the vacuum bag, vacuum motor, dirty solution tank, clean solution tank and suction motor, can be mounted on the handle, or the foot.

A canister cleaning machine usually comprises a canister housing which supports the vacuum motor and bag or dirty water receptacle. A long hose and wand extend from the canister housing and a cleaning foot or one of a variety of tools is attached to the terminal end of the wand.

A recent trend has been to develop multi-use upright vacuum cleaners which combine the compact structure and vertical orientation of an upright vacuum with the extension capabilities of a hose and wand. Such a multi-use machine can be used as an upright vacuum cleaner to clean carpeting or use the extendable hose to clean upholstery, drapes, and the like. One example of a multi-use machine is manufactured by Windsor Industries, Inc. of Englewood, Colo., U.S.A. and sold under the trademark VERSAMATIC EC™. This vacuum comprises a floor engaging foot and an integral upright housing and elongated support member. The upright housing and elongated support member can be separated from the foot for use with a wand or other cleaning attachments. Other examples of similar multi-use machines are disclosed in U.S. Pat. No. 4,955,106 to Stein et al., issued September 11, 1990; U.S. Pat. No. 4,393,536 to Tapp, issued Jul. 19, 1983; U.S. Pat. No. 4,811,452 to Sumerau, issued Mar. 14, 1989; and U.S. Pat. No. 4,519,113 to Hippie, issued May 29, 1985.

Another modification to the basic structure of an upright vacuum cleaner is seen in U.S. Pat. No. 4,545,089 to Oxel, issued Oct. 8, 1985 and U.S. Pat. No. 4,467,493 to Buchtel, issued Aug. 28, 1984. In these references, a small hand-held vacuum is selectively mounted to the body of an upright vacuum.

Each of these several different prior multi-use upright cleaners suffer from the problem of the ability to use and operate the detachable wand or hand-held vacuum independently of or a significant distance from the body of the upright vacuum cleaner. Moreover, when using the hand-held vacuum independently of the body of the upright vacuum cleaner, it is important to minimize the weight and maximize the compact structure of the hand-held vacuum, making it easier to use the hand-held vacuum a significant distance from the body of the upright vacuum cleaner.

SUMMARY OF INVENTION

The multi-use cleaning machine with a detachable cleaning module according to the invention overcomes the problems of the prior art by combining, in a single unit, the desired ease of use, compact configuration, and performance of an upright cleaning machine with the portability and multiple applications of a portable, canister cleaning machine.

The cleaning machine according to the invention comprises a foot housing, a base member pivotally mounted to the foot housing and an elongated support member non-removably mounted at a lower portion thereof to the base during typical upright use of the cleaning machine. The elongated support member is adapted for use in pushing and pulling the base and the foot housing along the floor. The cleaning machine further comprises a portable cleaning module having a module housing, a receptacle supported in the module housing for collecting dirt, and a flexible conduit for conveying the collected dirt from the foot housing to the receptacle. A motor driven fan is supported in the module housing for creating working air flow suction within the conduit to convey the collected dirt to the receptacle. The module mounts the basic components of a cleaning machine, namely, a dirt receptacle, conduit, and motor-driven fan so that the receptacle, conduit, and motor-driven fan are connected together as a unit. The module is selectively and removably mounted to the base member at least through a mechanical interconnection so that the module can be separated from the foot housing, base, and elongated support member and be operated as a portable cleaning machine. The module is closely adjacent the elongated support member, extends upwardly along at least a portion of the length of the elongated support member, and in the preferred embodiment is adapted to pivot with the base and elongated support member relative to the foot housing when the module is mounted to the base. However, the module can be mounted to the foot housing when the handle is pivoted relative thereto. The module can be operated as a portable cleaning machine independently of and separate from the foot housing, base, and elongated support member when the module is separated from the base. The cleaning machine can be operated as an upright cleaner when the module is mounted to the base.

In one embodiment, the cleaning machine is a vacuum cleaning machine. Preferably, the receptacle in this embodiment comprises a conventional vacuum cleaning bag for collecting dirt and dust.

In another aspect, the cleaning machine comprises a water extraction cleaner. In this embodiment, the receptacle comprises a dirty solution tank for collecting used cleaning solution along with entrained dirt. In this embodiment, the cleaning module further comprises a cleaning solution receptacle which provides a ready reservoir of cleaning solution. A pump is also incorporated into the cleaning module for creating a supply of pressurized cleaning solution. The cleaning solution is selectively directed to a spray nozzle provided at the end of the accessory hose when the module is separated from the foot housing. Alternatively, the cleaning solution is directed to spray nozzles provided on the foot housing when the module is mounted thereto and the machine is used in an upright cleaning mode.

BRIEF DESCRIPTION OF THE DRAWINGS

The invention will now be described with reference to the drawings wherein.

DESCRIPTION OF THE PREFERRED EMBODIMENTS

Figure 1:
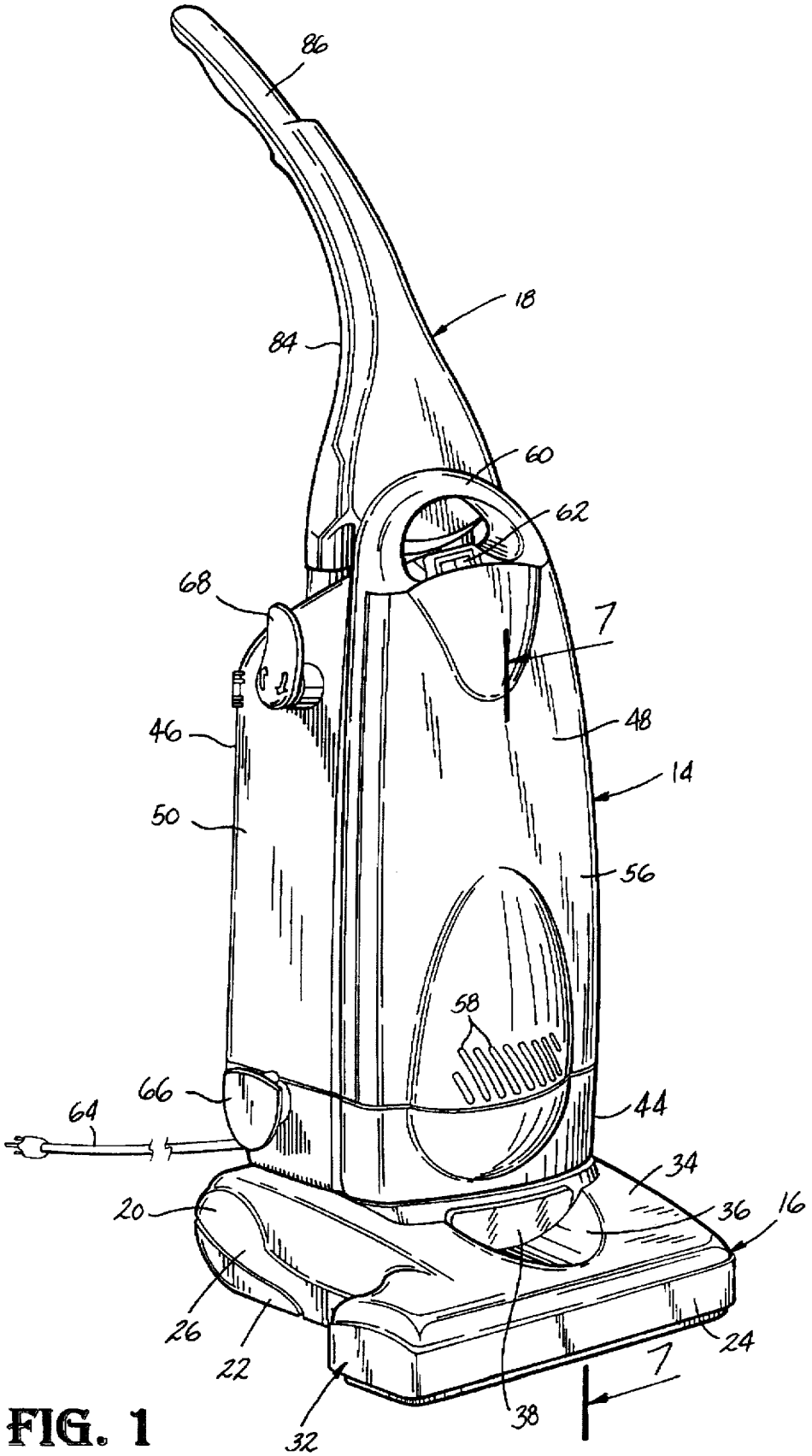
FIG. 1 is a perspective view of the multi-use vacuum cleaner having a detachable vacuum module according to the invention.
Figure 2:
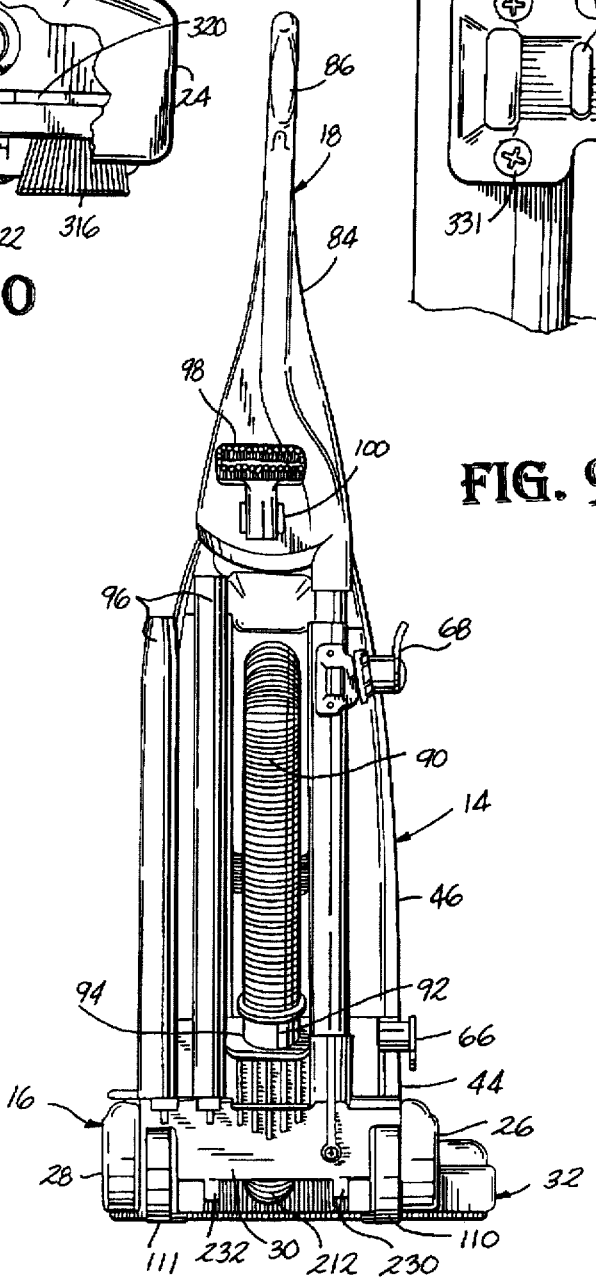
FIG. 2 is a rear elevational view of the multi-use vacuum cleaner of FIG. 1.

Referring now to the drawings, as seen in FIGS. 1 and 2, the multi-use vacuum 12 according to the invention comprises a floor engaging foot housing 16, a module 14 selectively mounted to the foot housing 16, and an elongated support assembly 18 mounted to the foot housing 16.

The foot housing comprises an upper housing member 20 and a lower housing member 22 which define the front wall 24, side walls 26, 28, and rear wall 30 of the foot housing 16. An edge cleaning projection 32 extends laterally outwardly from the side wall 26 of the foot housing. The upper surface 34 of the upper housing member 20 has a depression 36 formed therein which receives a lens 38.

The module 14 comprises a motor housing 44 and a bag housing 46 securely mounted to the top of the motor housing 44. The motor housing 44 and bag housing 46 define the front wall 48, side walls 50, 52, and rear wall 54 of the module 14. An access panel 56 is mounted to the front of the bag housing 46, and a plurality of exhaust slots 58 are formed adjacent the bottom edge of the access panel 56. A laterally-oriented, arcuate handle 60 is formed on the top of the bag housing 46, and a three position electrical switch 62 is mounted to the top of the bag housing 46 immediately adjacent the handle 60. An electrical cord 64 extends outwardly from the motor housing 44 and, as described further below, is adapted to supply all electrical current necessary for operation of the multi-use vacuum as an upright vacuum or as a portable vacuum module. A pair of cord wrap members 66, 68 extend outwardly from the si&wall 50 of the module 14 and arc adapted to receive the electrical cord 64 thereon.

The elongated support assembly 18 comprises a tubular support member 82 and a contoured support member 84 securely mounted to the top of the tubular support member 82. The bottom of the tubular support member 82 is securely mounted to the foot housing 16. A grip 86 is formed at the terminal end of the contoured support member One end of a flexible hose 90 is securely mounted to the upper portion of the rear wall 54 of the module 14. A collar 92 is mounted on the other end of the flexible hose 90 and the collar is selectively received in an integrally molded conduit 94 formed in the motor housing 44. The collar 92 and the integrally molded conduit 94 are preferably circular in cross section such that the outside diameter of the collar 92 closely approximates the inside diameter of the integrally molded conduit 94 resulting in a tight, substantially air-tight fit of the collar 92 in the integrally molded conduit 94.

A plurality of wand members 96 are selectively mounted to the rear of the foot housing 16, and an upholstery brush 98 is selectively mounted in a C-shaped mount 100 extending from the rear of the contoured support member In use, the collar 92 can be selectively withdrawn from the conduit 94 and one or more of the wand members 96 or brush 98 can be mounted to the collar 92 for cleaning drapes, upholstery, and other surfaces not suitable for cleaning by an upright vacuum cleaner.

Figure 3:
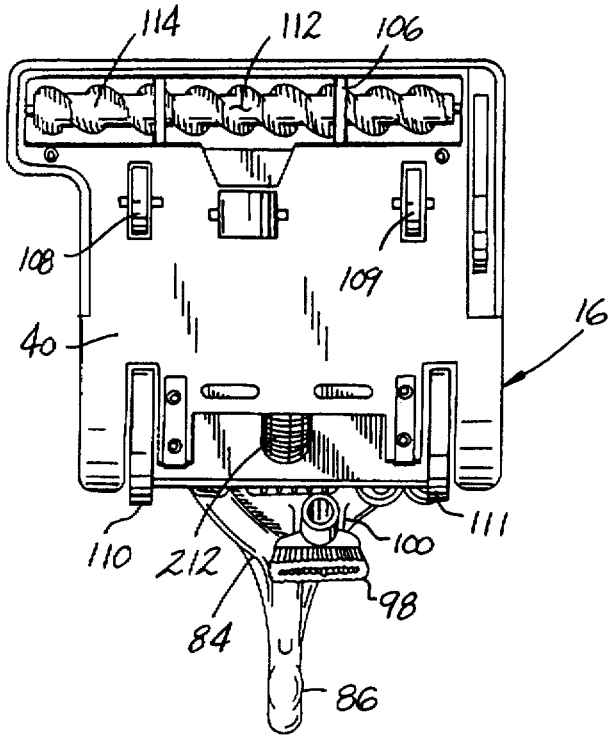
FIG. 3 is a bottom plan view of the multi-use vacuum of FIG. 1.

As seen in FIG. 3, the bottom surface 40 of the foot housing 16 has a sole plate 106 pivotally mounted thereto and from wheels 108, 109 and rear wheels 110, 111 extending downwardly therefrom. The sole plate 106 has a brush opening 112 formed therein, and the bristles of a conventional agitation brush 114 extend outwardly through the brush opening 112 a short distance to engage the surface to be cleaned.

Figure 4:
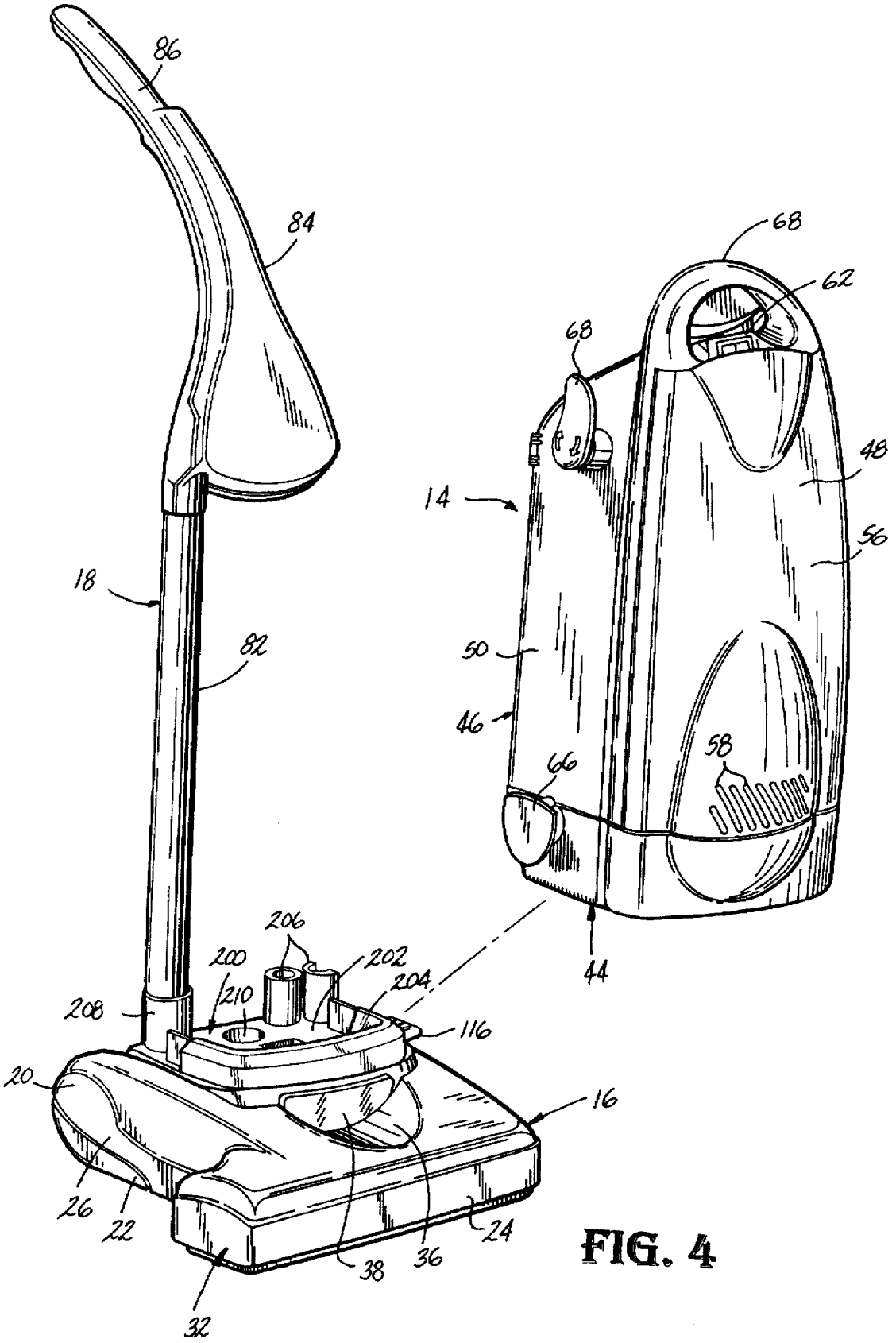
FIG. 4 is a perspective view of the vacuum module separated from the upright vacuum cleaner base.
Figure 6:
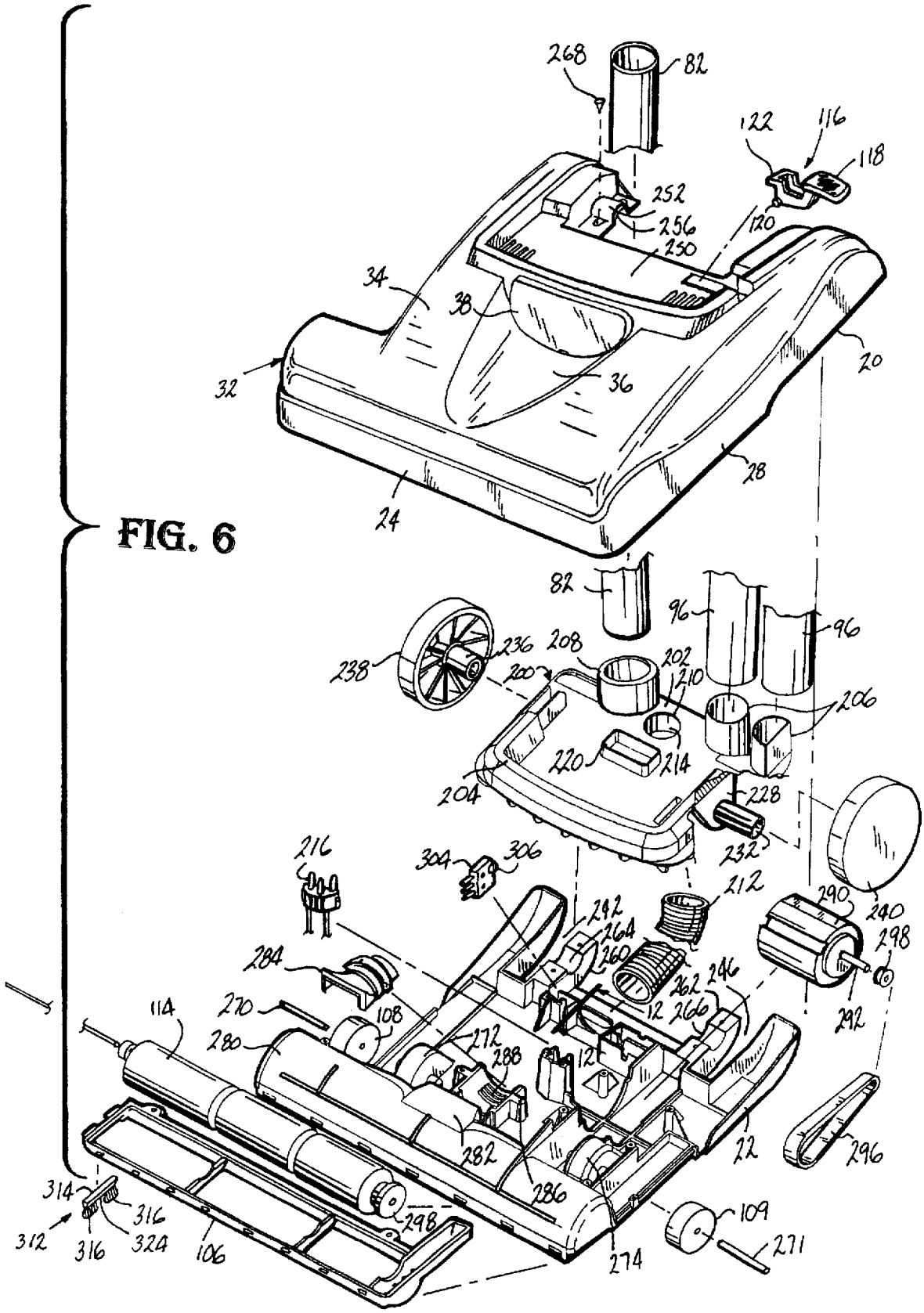
FIG. 6 is an exploded, perspective view of the foot housing.

As seen in FIG. 4, the module 14 is selectively mounted to the foot housing 16 and elongated support assembly 18. The module 14 is disengaged from the foot housing 16 by lifting of the module 14 relative to the foot housing 16. An L-shaped foot lever 116 is pivotally mounted in the foot housing 16. In use, the user presses down on the pedal portion 118 (FIG. 6) of the foot lever 116 causing the lever 116 to pivot about pivot pins 120 (FIG. 6). The downward force on the pedal portion 118 results in a lifting of the distal end 122 of the foot lever 116. The distal end 122 bears against the bottom surface of the module 14 and lifts the module 14 relative to the foot housing 16 and elongated support assembly 18.

With the vacuum module 14 detached from the foot housing 16 and elongated support assembly 18, the user can carry the module 14 and attach the wand members 96 and brushes 90 to the collar 92 for a wide variety of cleaning operations. As discussed in greater detail below, a latch mechanism 70 is mounted to the module 14 and tubular support member 82 for selectively interlocking the module 14 with the elongated support assembly 18.

Figure 5:
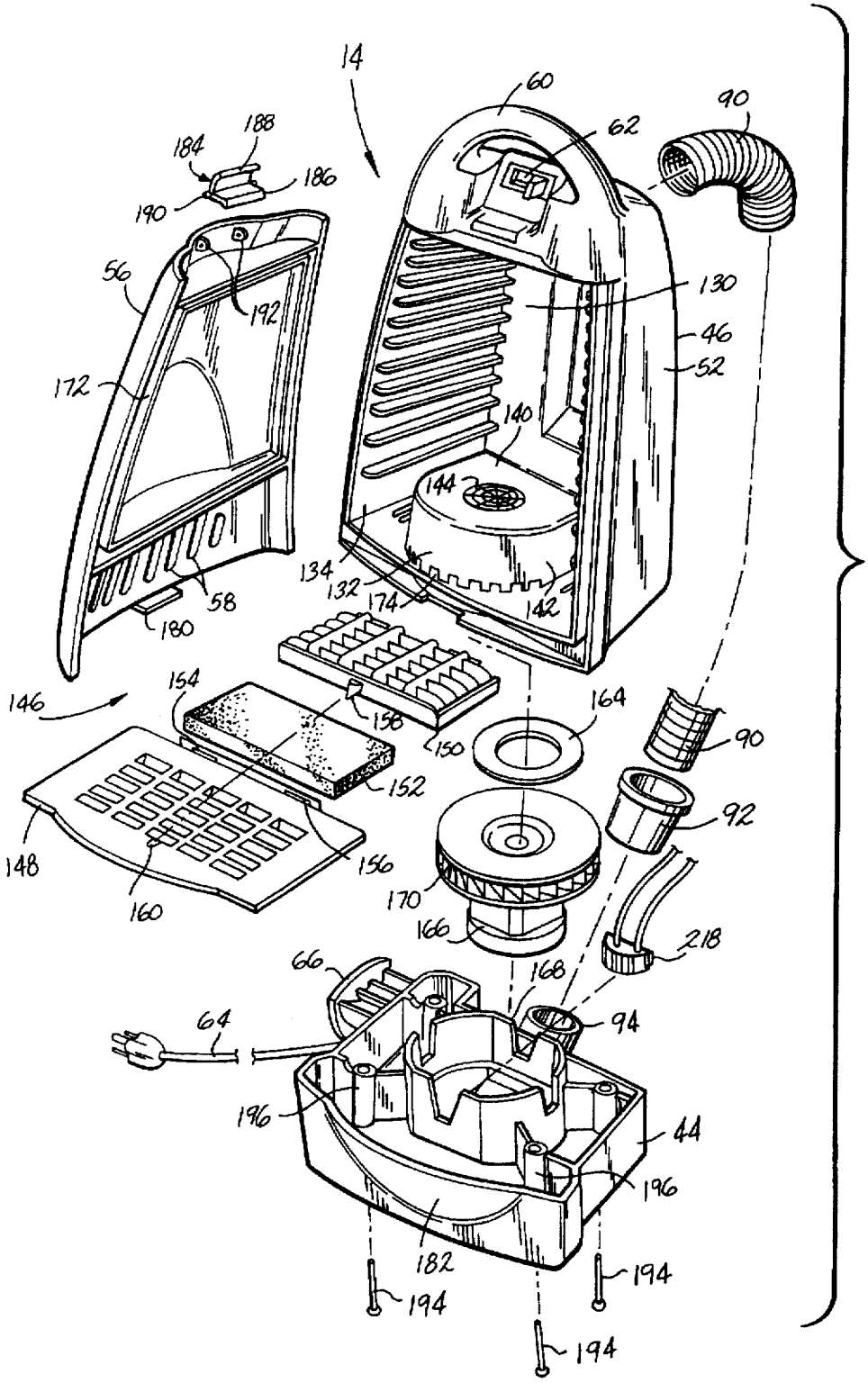
FIG. 5 is an exploded, perspective view of the vacuum module.
Figure 7:
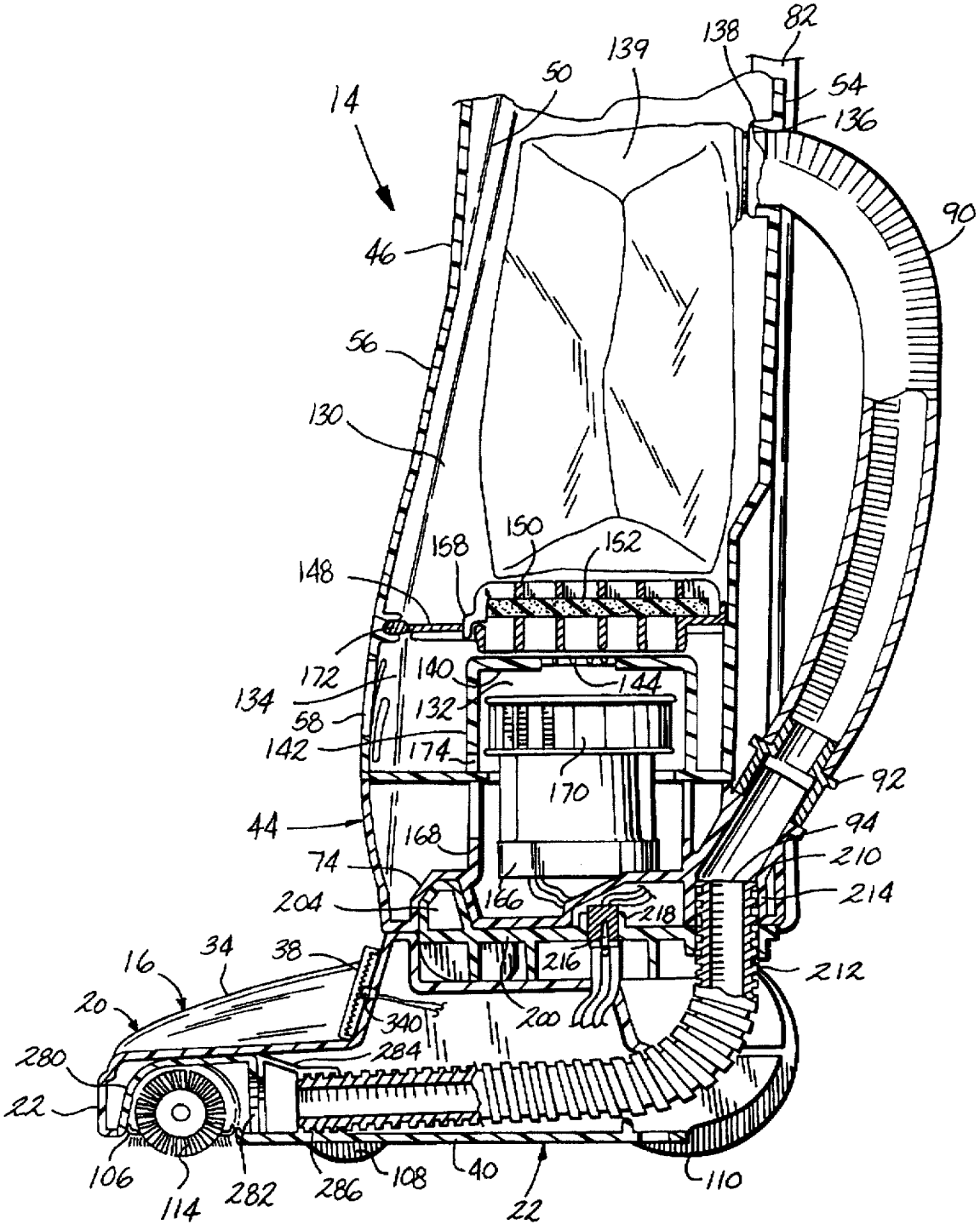
FIG. 7 is a partial, sectional view of the vacuum module and foot housing taken along lines 7—7 of FIG. 1.

As seen in FIGS. 5 and 7, the bag housing 46 of the module 14 comprises a bag chamber 130, a fan chamber 132, and an exhaust chamber 134. An inlet 136 is formed at the top of the rear wall 54. A bag mounting projection 138 extends inwardly from the rear wall 54 and is adapted to receive a conventional vacuum filter bag 139 thereon.

The fan chamber 132 is defined by a top wall 140 and a U-shaped side wall 142 which extends outwardly from the rear wall 54. An outlet opening 144 is formed in the top wall 140 of the fan chamber 132. A filter assembly 146 is selectively mounted inside the bag chamber 130 and serves to separate the bag chamber 130 from the fan and exhaust chambers 132, 134. The filter assembly 146 comprises a lower grill member 148, an upper grill member 150 selectively mounted to the lower grill member, and a filter 152 mounted between the lower and upper grill members 148, 150. The lower grill member 148 has a pair of grooves 154, 156, each of which receive a tongue extending rearwardly from the upper grill member 150. A locking tab 158 is formed on the front of the upper grill member and is selectively received in a locking slot 160.

The lower grill member 148 is mounted in the module 14 such that the lower grill member 148 separates the bag chamber 130 from the fan and exhaust chambers 132, 134.

An electric vacuum motor 166 is received in a motor mount 168 of the motor housing 44. A fan 170 mounted on top of the electric motor 166 is received in the fan chamber 132 of the bag housing 46. The electric motor 166 rotates the fan 170 to draw air from the bag chamber 130 through the outlet opening 144. The air removed from the bag chamber 130 is replaced by the flow of incoming air through the inlet 136. A rubber gasket 164 seals the fan 170 and the bottom surface of the top wall 140 of the fan chamber 132. An elastomeric seal 172 extends along the side and top edges of the access panel 56 and along the inside surface of the access panel corresponding to the front edge of the lower grill member 148. When the access panel 56 is mounted to the bag housing 46, the elastomeric seal 172 abuts the lower grill member 148 and the edges of the bag chamber 130, thereby creating a substantially air-tight seal, except for the inlet 136 and outlet 144.

As air is withdrawn from the bag chamber 130 and passes through the filter 152, the air is drawn through the fan chamber 132 and enters the motor housing 44 and ultimately the exhaust chamber 134 through a plurality of exhaust openings 174 in the walls of the fan chamber. The air exits the exhaust chamber 134 through the exhaust vents 58 formed in the access panel 56.

The access panel 56 is selectively mounted to the module 14 by a downwardly extending tongue 180 which is received inside the front wall 182 of the motor housing 44 and a finger latch 184 pivotally mounted to the inside surface of the top of the access panel 56. The finger latch 184 has a hook or latching portion 186, a finger grip portion 188, and a pair of opposed pivot pins 190. The pivot pins are selectively received in pin mounts 192 integrally molded on the inside surface of the access panel 56. The hook portion 186 selectively engages the top edge of the bag housing 46 to selectively mount the access panel 56 to the module 14.

The motor housing 44 is securely mounted to the bag housing 46 by a plurality of conventional fasteners or screws 194 which extend upwardly from a plurality of bosses 196 of the motor housing to engage the bottom of the motor housing 44.

Figure 8:
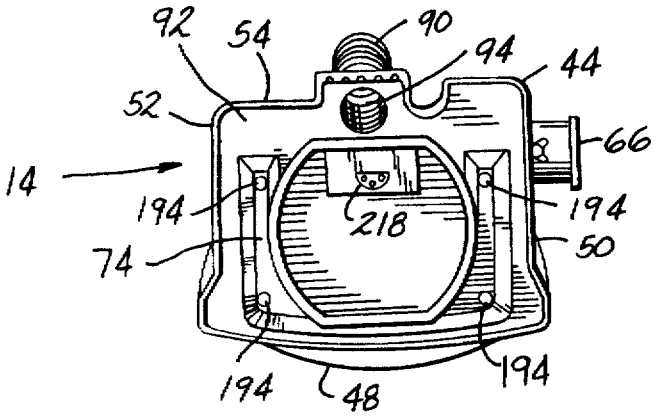
FIG. 8 is a bottom plan view of the vacuum module.

As seen in FIGS. 4, 6, and 8, the module 14 is selectively mounted to a base support member 200 which is, in turn, pivotally mounted to the foot housing 16. The base support member 200 comprises a top surface 202 and a U-shaped projection 204 extending upwardly from the top surface 202. The projection 204 is received in a complementary recess 74 (FIG. 8) formed on the bottom surface of the module 14.

Wand support projections 206 extend upwardly from the top surface at the rear of the base support member 200 and are adapted to be telescopically received inside the hollow wand members 96 (FIG. 2). A mount 208 for the tubular support member 82 also projects upwardly from the top surface 202 of the base support member 200. The bottom end of the tubular support member 82 is telescopically received inside the mount 208 and secured thereto by conventional fasteners (not shown). A vacuum hose opening 210 is also formed on the top surface 202 in a position such that when the module 14 is mounted to the base support member 200, the vacuum hose opening 210 abuts the opening of the conduit 94 on the bottom of the module 14. One end of a flexible vacuum hose 212 is mounted on a hose projection 2 14 which extends downwardly from the base support member 200.

The male connector 216 of an electrical connector 215 extends upwardly from the top surface 202 and is adapted to engage female connectors 218 (FIG. 8) mounted to the bottom surface of the module 14. The male connectors 216 are surrounded by an upwardly extending collar 220 which protects the male connectors 216 and assures proper alignment of the module 14 as it is received on the base support member 200.

A pair of axle flanges 226, 228 are spaced from one another and extend downwardly from the bottom surface of the base support member 200. A pair of tubular axle supports 230, 232 extend laterally outwardly from the flanges 226, 228. The axle supports 230, 232 are hollow and are adapted to telescopically receive and support axles 236 of the rear wheels 238, 240. When assembled, the rear wheels 238, 240 are received in wheel recesses 242, 246 formed in the rear of the lower housing member 22.

The upper surface 34 of the upper housing member 20 has a depression 250 formed therein which selectively receives the base support member 200. The rear portion of the upper housing member 20 is cut out to receive the downwardly extending axle flanges 226, 228. Immediately adjacent the cut out portion is a pair of upper support flanges 252, 254 which have laterally extending semi-circular recesses 256, 258 integrally molded therein.

The rear portion of the lower housing member 22 has a pair of lower support flanges 260, 262 which have semi-circular recesses 264, 266 formed therein. In the assembled condition, the upper and lower support flanges abut one another and the semi-circular recesses of the flanges define a circular pivot mounting for the laterally extending axle supports 230, 232 of the base support member 200. Conventional fasteners 268 securely mount the upper and lower support flanges to one another. With the upper and lower support flanges secured to one another and the axle supports 230, 232 received therein, the base support member 200 is pivotally mounted to the assembled foot housing 16.

As seen in FIG. 6, the front wheels 108, 109 are rotatably supported by axles 270, 271 in front wheel recesses 272, 274 formed in the lower housing member 22. As described earlier, a conventional brush 114 is rotatively mounted in a brush chamber 280 formed at the front of the lower housing member 22. The brush chamber 280 is open on the bottom thereof and has an outlet 282 at the rear thereof. The second end of the vacuum hose is securely mounted adjacent the outlet 282 through the cooperation of a transition member 284 and a base member 286. The second end of the corrugated vacuum hose 212 cooperates with a plurality of upwardly extending fibs 288 formed in the base member to prevent inadvertent removal of the vacuum hose from the assembled transition member 284 and base member 286. The transition member 284 is mounted on top of the base member 286 and encloses the second end oft he vacuum hose 212 and completes the fluid conduit between the brush chamber outlet 282 and the vacuum hose 212.

Figure 11:
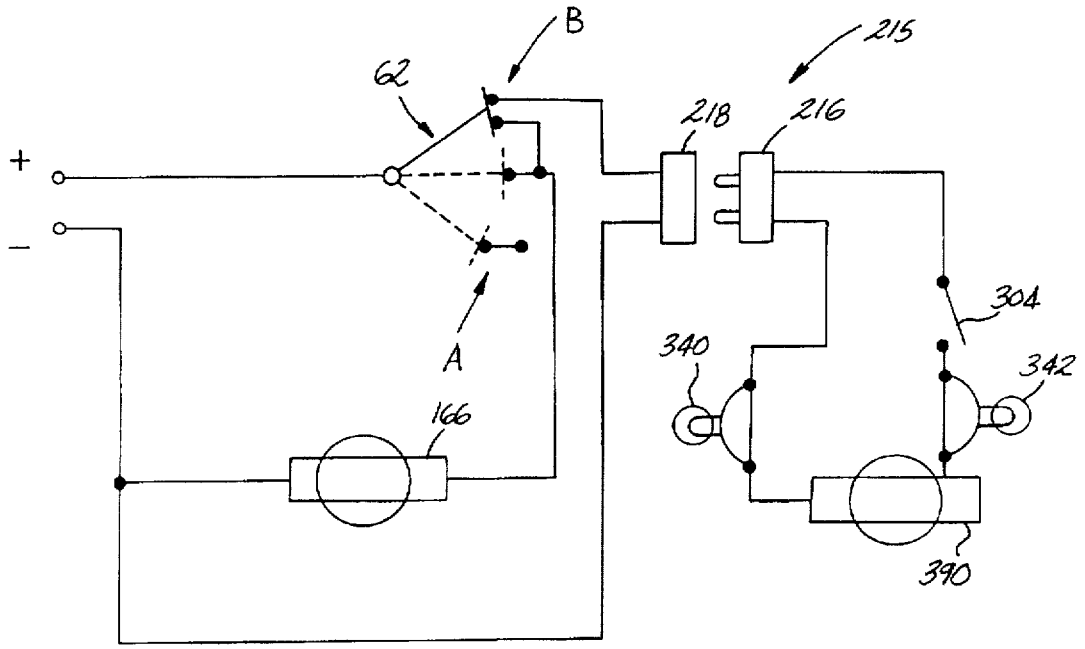
FIG. 11 is a schematic diagram of the electrical wiring of the multi-use vacuum according to the invention.

The brush motor 290 is securely mounted to the lower housing member 22 such that the outwardly extending drive shaft 292 and pulley 294 supported thereon are received around one end of the brush belt 296. The other end of the brush belt 296 is received on the pulley 298 of the brush 114. Electrical current for powering the brush motor 290 is supplied to the foot housing through the interconnection between the male and female connectors 216, 2 18 of the electrical connector 215 (FIG. 11 ).

Figure 12:
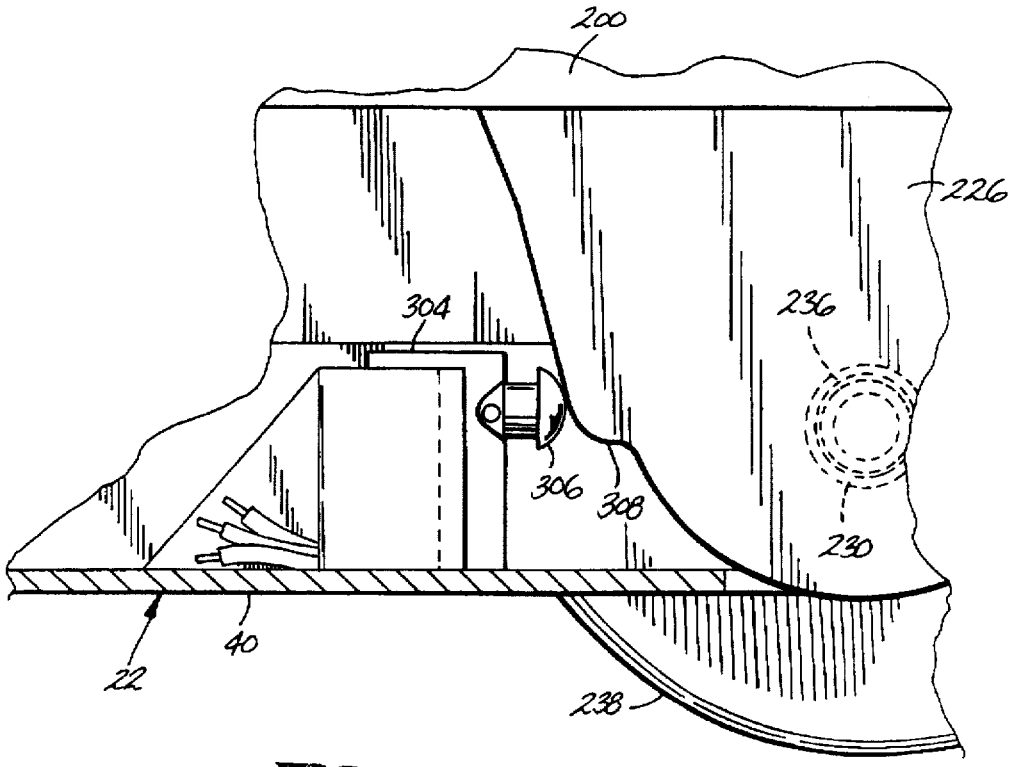
FIG. 12 is a detail, sectional view of the foot housing showing the means for opening and closing the electrical circuit between the source of electricity and the brush motor.
Figure 13:
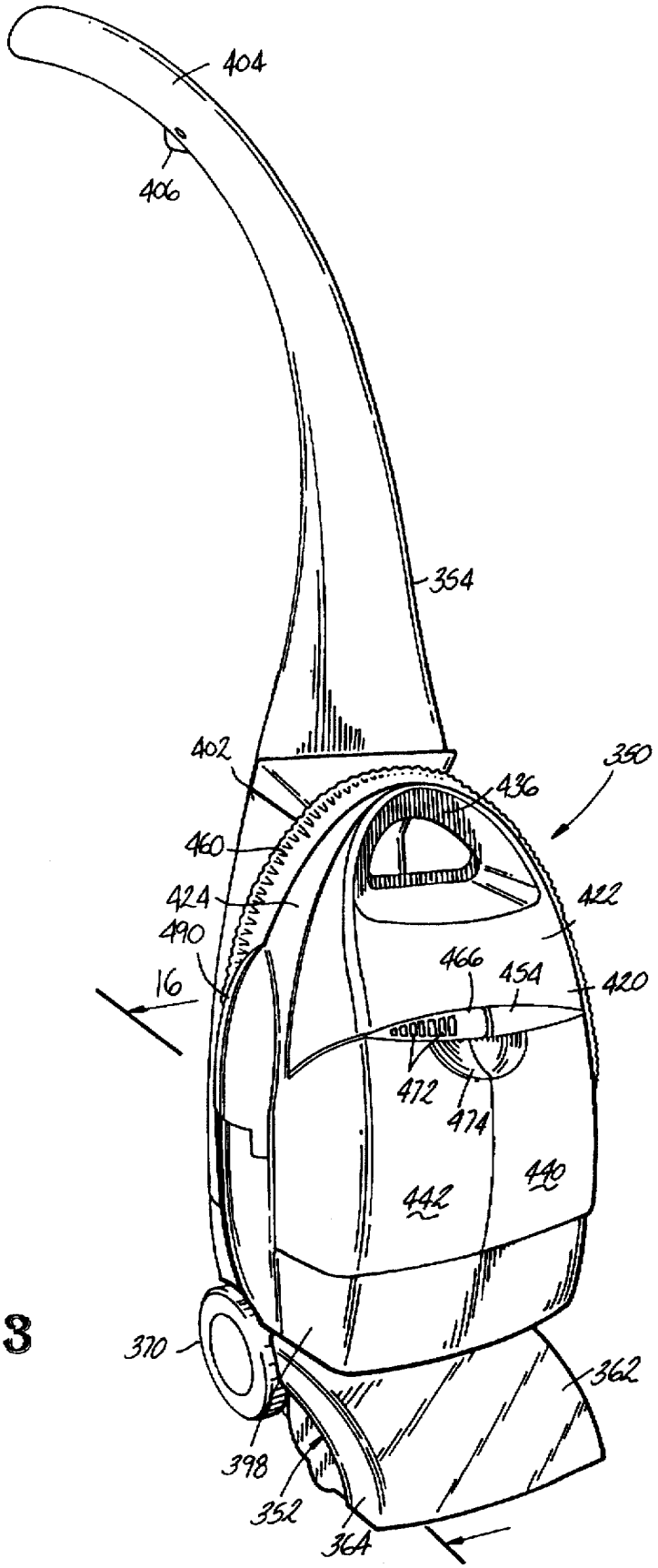
FIG. 13 is a perspective view of a second embodiment of a multi-use cleaning machine having a detachable cleaning module according to the invention.

When the module 14 is mounted to the base support member 200 and the electrical connector 215 is assembled, it is not always desirable to energize the brush motor 290 to rotate the brush 114. For example, when the elongated support assembly 18 is in the upright position and the user has removed the collar of the flexible hose 90 from the conduit 94 to clean drapes or the like, then it is undesirable to have continued rotation of the brush 114. As seen in FIGS. 6 and 12, a second electrical switch 304 is mounted in the lower housing member 22 and is adapted to open the electrical circuit between the brush motor 290 and the source of electricity when the elongated support assembly 18 is in the upright position. The second electrical switch 304 is mounted in the lower housing member 22 immediately adjacent one of the axle flanges 226 of the base support member 200. The second electrical switch 304 has a spring biased switch member 306 which is selectively engaged by an outwardly extending cam projection 308 formed on the axle flange 226. In the upright position, the cam projection 308 depresses the switch member 306 and opens the electrical circuit thereby preventing the supply of electrical current to the brush motor 290. As the elongated support assembly 18 and base support member 200 are pivoted out of the upright position, the cam projection 308 is rotated out of engagement with the spring biased switch member 306 which will extend outwardly. As the switch member 306 extends, electrical contacts (not shown) within the electrical switch 304 complete the electrical circuit to the brush motor 290 thereby resulting in rotation of the brush 114.

Figure 10:
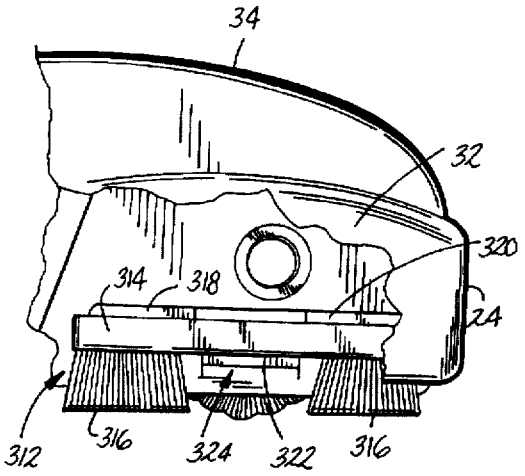
FIG. 10 is a side-elevational view of the edge cleaning projection of the foot housing.

As seen in FIGS. 1, 6, and 10, an edge cleaning brush 312 is mounted to the side of the sole plate 106. The edge cleaning brush comprises a bristle support member 314 and a plurality of bristles 316 grouped adjacent the forward and rear edge of the support member 314 and defining an opening 324 therebetween. The bristle support member 314 is selectively received between a pair of upper support tabs 318, 320 and a lower support tab 322 extending laterally out of the side of the sole plate 106. The tabs 318, 320 and 322 are preferably formed of a resilient material and spaced such that the bristle support member 314 is snap-fit between the tabs.

The edge cleaning brush 312 is mounted to the outside edge of the edge cleaning projection 32 of the foot housing 16. As the edge cleaning projection 32 is maneuvered adjacent the comer between the wall and the carpeted surface being vacuumed, the resilient bristles 316 of the edge cleaning brush 312 will loosen and agitate dirt and dust in the comer such that the dirt and dust will be caught in the vacuum airflow passing through the opening 324 between the groupings of bristles 316.

Figure 9:
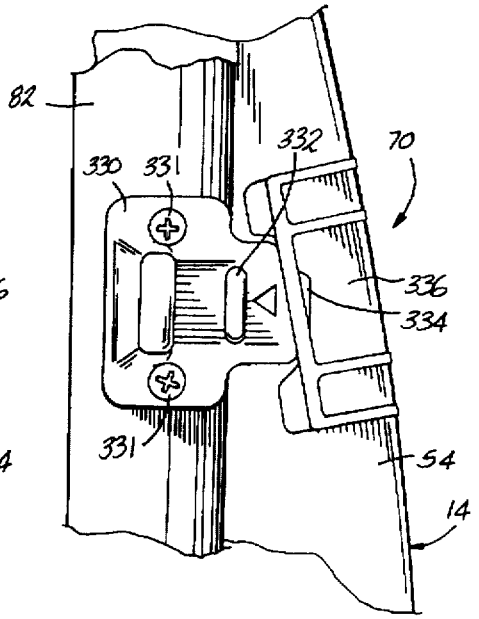
FIG. 9 is a detailed, rear elevational view of the vacuum module latch as seen in FIG. 2.

As seen in FIG. 9, the upper portion of the module 14 is selectively mounted to the tubular support member 82 by the latch mechanism 70. The latch mechanism comprises a latch housing 330 which is securely mounted to the tubular support member 82 by conventional fasteners 331. A latch member 332 is slidably mounted in the housing 330 for movement between an extended and a retracted position. A spring (not shown) mounted within the latch housing 330 biases the latch member in the extended position. The latch member 332 has an outwardly extending interlocking projection 334 which is selectively extended out of or retracted into the latch housing. A locking member 336 is mounted to the rear wall 54 of the module 14 in a position such that a slot formed in the locking member 336 will receive the interlocking projection 334 of the latch member 332 when the latch member 332 is in the extended position, thereby locking the module 14 to the elongated support assembly 18.

In use as an upright vacuum, the user moves the electrical switch 62 from the off position A to the vacuum and brush position B (FIG. 11). Therefore, electrical current is supplied to the electric vacuum motor 166 thereby creating a source of suction through the flexible hose 90, conduit 94, vacuum hose opening 210, vacuum 212 and brush chamber 280. When the user pivots the elongated support assembly 18 out of the upright position, the cam projection 308 will disengage the switch member to close the second electrical switch 304 thereby supplying electrical current to the brush motor 290 and to a pair of lights 340, 342 mounted in the foot housing 16 beneath the lens 38.

In order to use the wand members 96 or upholstery brush 98, the user pivots the elongated support assembly 18, base support member 200, and module 14 into the upright position causing the cam projection 308 to engage the switch member 306 to open the second electrical switch 304 and open the electrical circuit between the source of electricity and the brush motor 290. Next, the user removes the collar 92 from the conduit 94 of the motor housing 44 and mounts the desired wand members or cleaning tools to the collar for the particular cleaning operation desired. To resume use as an upright vacuum, the user merely replaces the collar 92 in the conduit 94 and pivots the elongated support member 18 and base support member 200 rearwardly.

The module 14 can be quickly and easily separated from the foot housing 16 and elongated support assembly 18 for use at unlimited distances from these elements. First, the user pivots the elongated support assembly 18 and base support member 200 into the upright position. Then, the user grasps the arcuate handle 60 and lifts upwardly while depressing the foot lever 116. The module 14 separates from the base support member 200 and the male and female connectors 216, 218 of the electrical connector 215 are separated from one another. Now, the module 14 can be carried outside for cleaning the interior of a car or carried up the stairs for cleaning stairs. The module 14 is relatively lightweight and compact and can be easily carried about for a variety of applications.

A second embodiment of a multi-use cleaning machine according to the invention is seen in FIGS. 13–18. In this embodiment, the multi-use cleaning machine 350 comprises a floor engaging foot housing 352, an elongated support member 354 pivotally mounted to the foot housing 352 and a cleaning module 356 selectively mounted to the elongated support member 354. In an alternative embodiment, not shown, the cleaning module 356 could be selectively mounted to the foot housing 352 rather than to the elongated support member 354, as shown.

The foot housing 352 comprises a base pan 358 and a hood 360 mounted thereto. The hood 360 comprises a top surface 362 and a pair of downwardly extending side walls 364. A recess is provided in the top surface of the hood. The recess cooperates with a preferably transparent nozzle cover plate 368 to define a suction nozzle fluid pathway therethrough, as described further below.

The rear portion of the foot housing 352 is supported by a pair of wheels 370 and the base pan 358 of the housing 352 is contoured to receive and rotatably mount an agitation brush 372. Preferably, the brush 372 is positioned adjacent the suction nozzle opening 374 which is provided along the leading edge of the foot housing 352. Rotation of the brush 372 is controlled by a motor 376 provided inside the foot housing 352. A conventional belt 378 interconnects the motor 376 and brush 372.

The foot housing 352 also supports a spray bar 386 which comprises a central manifold 388 and a plurality of nozzle outlets 390 spaced intermittently along the length of the manifold 388. As described further below, pressurized cleaning solution is provided to the spray bar 386 for distribution onto the surface to be cleaned through the nozzle outlets 390. While the preferred embodiment incorporates a spray bar, any conventional means such as one or more spray nozzles can be incorporated.

The elongated support member 354 comprises a base plate 392 along with a front wall 394, a rear wall 396 and opposed sidewalls 398, 400 extending upwardly therefrom. A tapered body member 402 extends upwardly from the rear wall 396 and terminates at a hand grip 404. A trigger mechanism 406 is provided adjacent the hand grip 404 for selectively actuating the distribution of cleaning solution through the spray bar 386. The trigger 406 is mounted to one end of a push rod 407 which is slideably mounted in the elongated support member 354 and the foot housing 352. The lower end of the push rod 407 contacts a valve 409 provided in the solution conduit 508. As the trigger 406 is squeezed, the push rod 407 is displaced downwardly with respect to the valve 409, causing the valve to open. When the user ceases squeezing the trigger 406, the spring biased valve will return to the closed position, thereby preventing the flow of fluid through the conduit 508.

The base plate 392 also comprises a male electrical connector 408 which is adapted to be selectively connected to a female electrical connector 410 provided on the bottom surface of the cleaning module 356. A pair of conventional wires extend from the male electrical connector 408 to the agitation brush motor 376.

Figure 14:
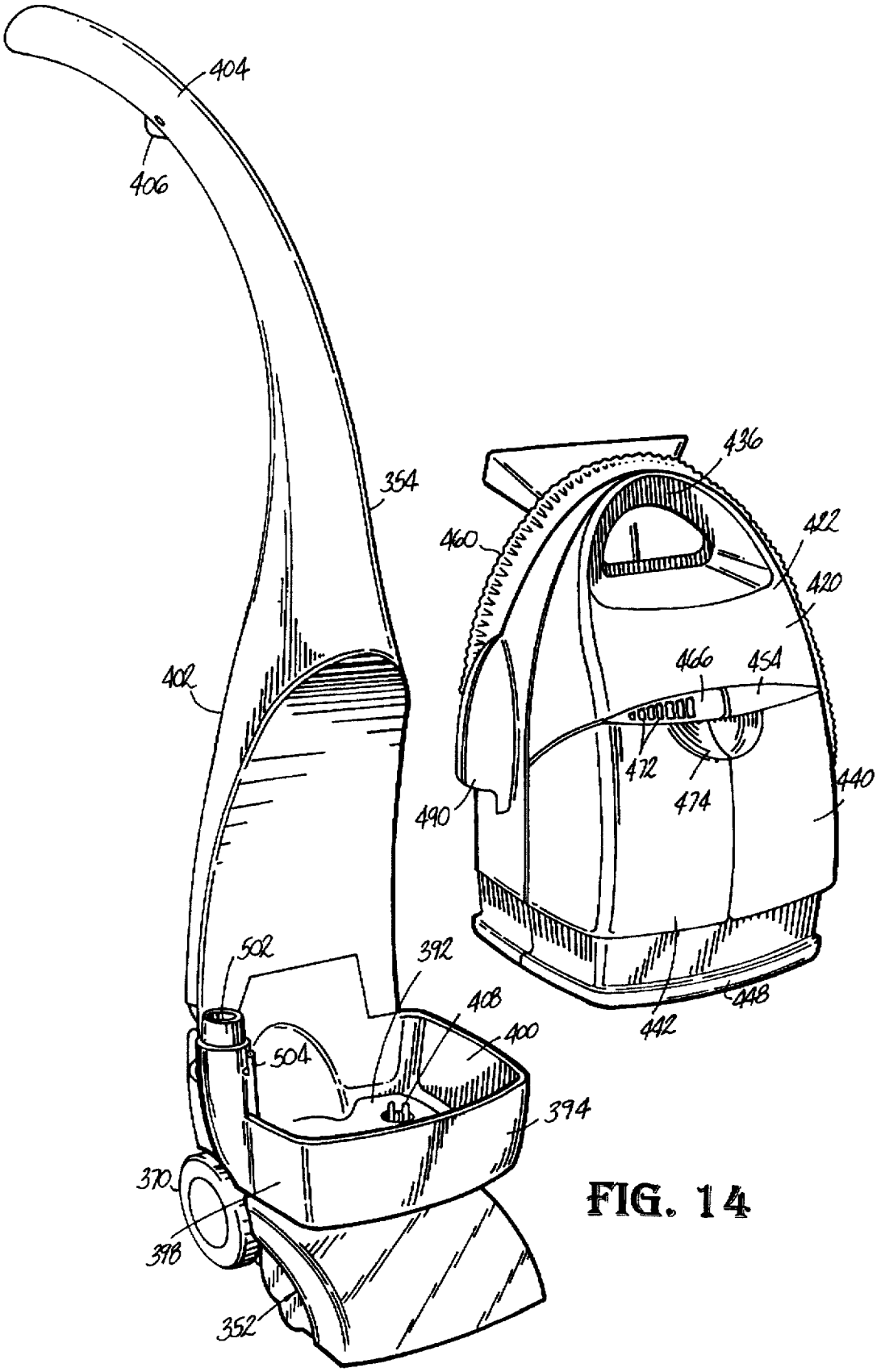
FIG. 14 is an exploded, perspective view of the multi-use cleaning machine as seen in FIG. 13.
Figure 15:
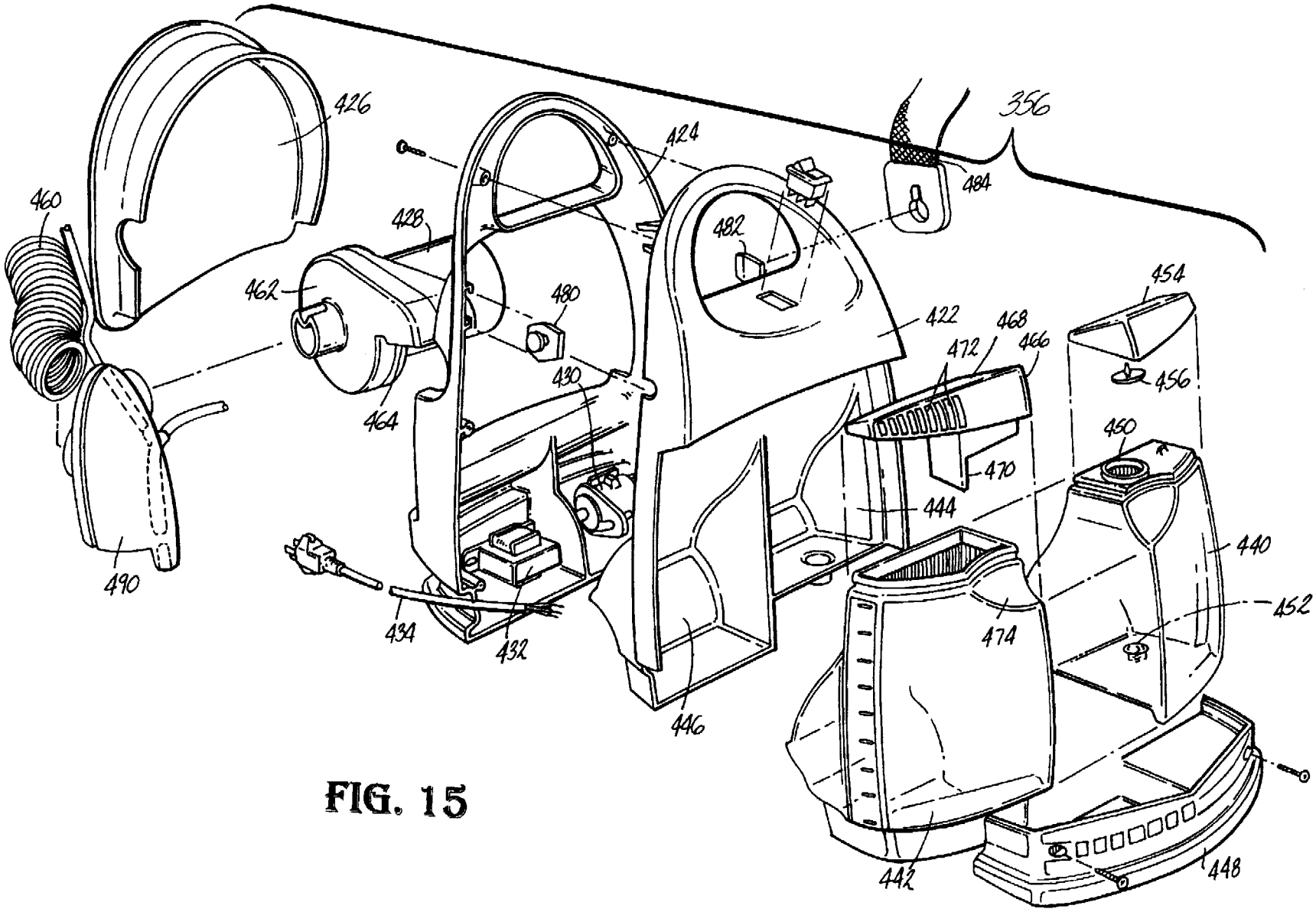
FIG. 15 is an exploded, perspective view of the cleaning module of FIG. 13.
Figure 16:
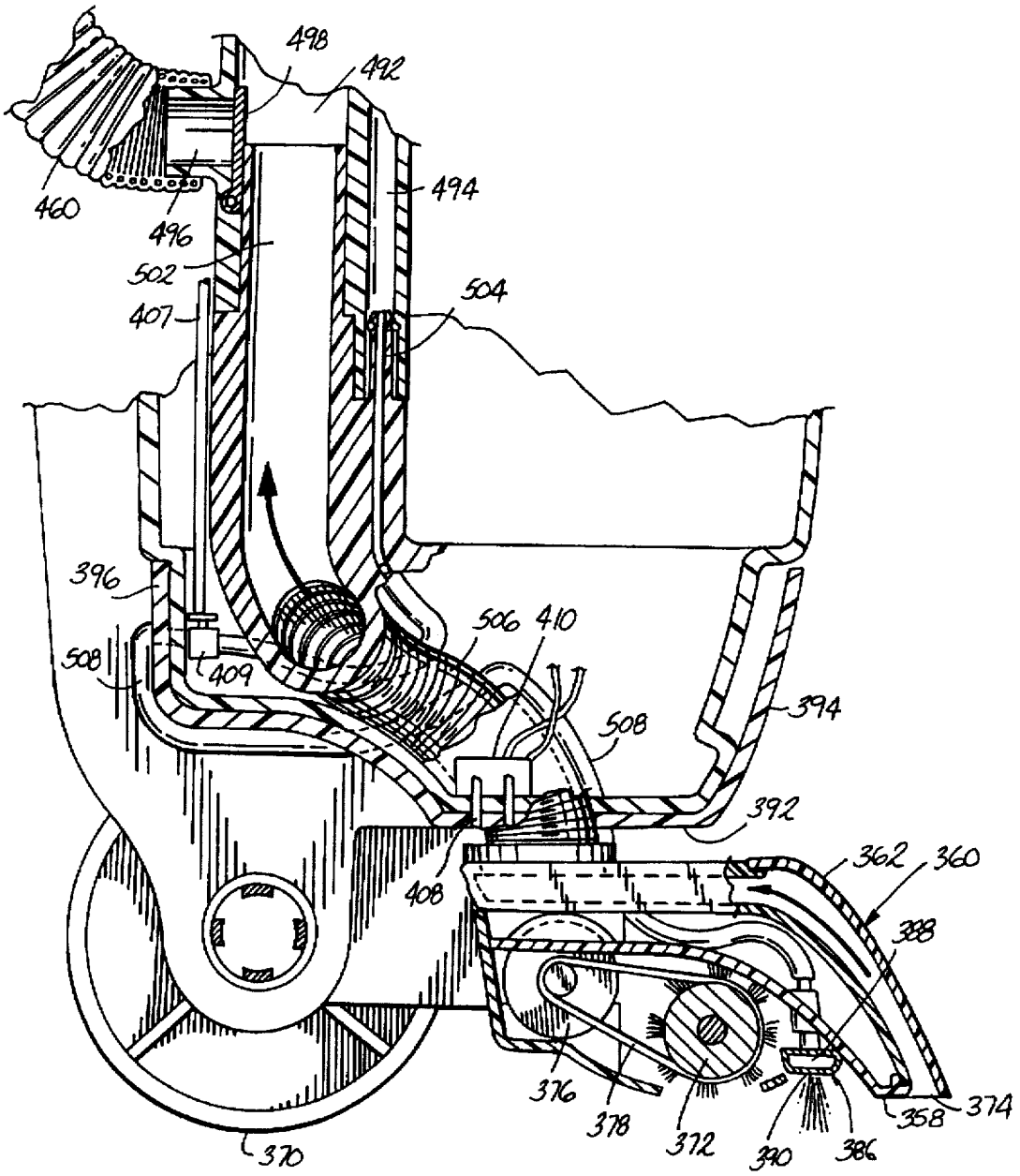
FIG. 16 is a partial, sectional view of the cleaning machine taken along lines 16—16 of FIG. 13.

As seen in FIGS. 14 and 15, the cleaning module 356 comprises a housing 420 formed from a front member 422 and a rear member 424 and a back plate 426 secured to the rear member 424. The front member 422, rear member 424 and back plate 426 are mounted to one another to define the housing 420 which supports the operative components oft he cleaning module 356, namely, the vacuum motor 428, the cleaning solution pump 430 and a transformer 432 adapted to reduce the current from the incoming electrical line 434 to an acceptable level for use by the solution pump 430 and the brush motor 376 (FIG. 16). The front and rear members 422, 424 cooperate to define a carrying handle 436 provided at the top of the housing 420.

A clean solution tank 440 and a dirty solution tank 442 are selectively mounted into a pair of contoured recesses 444, 446 provided in the front member 422. The rear surfaces of the tanks 440, 442 are substantially complementary to the recesses 444, 446. A base member 448 is secured to the bottom, front edge of the front member 422 to create an acceptable support surface for the base of the tanks 440, 442.

The clean solution tank 440 has an inlet opening 450 provided on the top surface thereof and an outlet opening 452 provided on the bottom thereof. A conventional ball plunger valve (not shown) is inserted in the outlet opening to control the discharge of solution from the tank 440. A cap 454 is provided for selectively closing the inlet opening 450 at the top of the tank 440, and a conventional pressure release umbrella valve 456 is provided in the cap 454 to allow the fluid to flow from the tank without developing a significant pressure differential inside and outside the tank 440. In use, the operator removes the tank 440 from the housing 420 and removes the cap 454 therefrom. Water and cleaning solution in an appropriate ratio are poured into the tank 440 through the inlet opening 450. When the tank 440 is removed from the housing 420, the spring-biased ball valve provided in the outlet opening 452 is biased closed. Once the desired amount of water and solution have been poured into the tank, the user replaces the cap 454 and inserts the tank 440 back into the appropriate recess 444 of the housing 420. As the tank 440 is replaced, a plunger extending upwardly from the housing 420 biases the ball valve to the open position thereby permitting the flow of fluid from the tank to the pump 430, as needed, through a suitable conventional conduit (not shown).

The cleaning module 356 of the preferred embodiment is a dirty air system in that dirty water picked up through the accessory hose 460 passes through the hose, enters the impeller chamber 462 and is then conducted to the dirty solution tank 442. The impeller chamber 462 has an outlet 464 provided thereon which is in fluid communication with an air/water separator cap 466 selectively mounted in the open top of the dirty solution tank 442. The air/water separator cap 466 comprises an inlet aperture 468 and at least one baffle 470 extending downwardly into the tank 442. A plurality of exhaust outlets 472 are provided in the cap 466 and are separated from the inlet aperture 468 by the at least one baffle 470.

In operation, the fan of the vacuum motor 428 draws water and entrained dirt through the accessory hose 460 into the impeller chamber 462. The water and dirt is discharged from the chamber 462 through the outlet 464 into the air/water separator cap 466 and ultimately into the dirty solution tank 442. The pressurized air is eventually discharged from the tank 442 through the exhaust outlets 472. The air/water separator cap 466 and baffle wall 470 create a tortious path for the air flow, thereby resulting in the separation of the water and entrained dirt from the air. The water and dirt fall into the tank as the air is discharged out the outlet 472.

When necessary, the user can quickly and easily remove the dirty solution tank 442 from the housing 420 by inserting fingers into the finger recess 474 and tilting the top of the tank 442 forward and then lifting it out of the recess 444. Next, the air/water separator cap 466 is removed and the dirt and water is poured from the tank 442. Finally, the user replaces the cap 466 and then reinserts the tank 442 into the recess 446 of the housing 420.

The housing 420 also comprises a pair of outwardly-extending strap supports 480, 482 which are mounted between the front and rear members 422, 424. The pegs 480, 482 are adapted to receive one end of a carrying strap 484. When desired, the user can attach the ends of the strap 484 to the pegs 480, 482 when the cleaning module 356 is used separately from the elongated support member 354.

The cleaning module 356 is selectively mounted to the foot housing 352 and elongated support member 354. When the module 356 is attached to these elements, then the unit is ideally suited for use as an upright, on-the-floor cleaner.

The cleaning module 356, as in the earlier vacuum embodiment, can be quickly and easily removed from the elongated support member 354 and foot housing 352 for use at an unlimited distance from these elements for a variety of cleaning operations such as cleaning upholstery, drapes, stairs, and the like.

In order to convert the cleaning module 356 between on-the-floor cleaning and above-the-floor cleaning, air flow ducting must be provided for quickly and easily redirecting the working air from the floor suction nozzle opening 374 to the accessory hose 460. As seen in FIGS. 15–18, a conversion valve housing 490 is provided on the side of the cleaning module 356. The valve housing 490 comprises a downwardly extending working air conduit 492 and a parallel, downwardly extending solution conduit 494. A hose mounting boss 496 extends laterally from the housing 490 and is adapted to receive one end of the accessory hose 460. A spring biased, pivotally mounted flapper valve 498 is provided immediately adjacent the hose mounting boss 496 and working air conduit 492. As described further below, the flapper valve 498 is adapted to control the direction of the air flow between the floor suction nozzle opening 374 and the accessory hose 460.

The foot housing 352 is provided with an upwardly extending working air flange 502 and a solution conduit flange 504. The working air flange 502 is rigid and complementary to the working air conduit 492 of the module 356 and functions as an actuator for the flapper valve 498. Similarly, the solution conduit flange 504 is rigid and complementary to the interior of the solution conduit 494 and functions as an actuator for the solution conduit valve 510. One end of a flexible hose 506 is mounted to the base of the working air flange. The other end of the flexible hose 506 is mounted to the terminal end of the suction nozzle of the foot housing 352.

One end of a solution conduit 508 is mounted to the terminal end of the solution conduit flange 504 and the other end of the solution conduit 508 is mounted to the spray bar 386.

Figure 18:
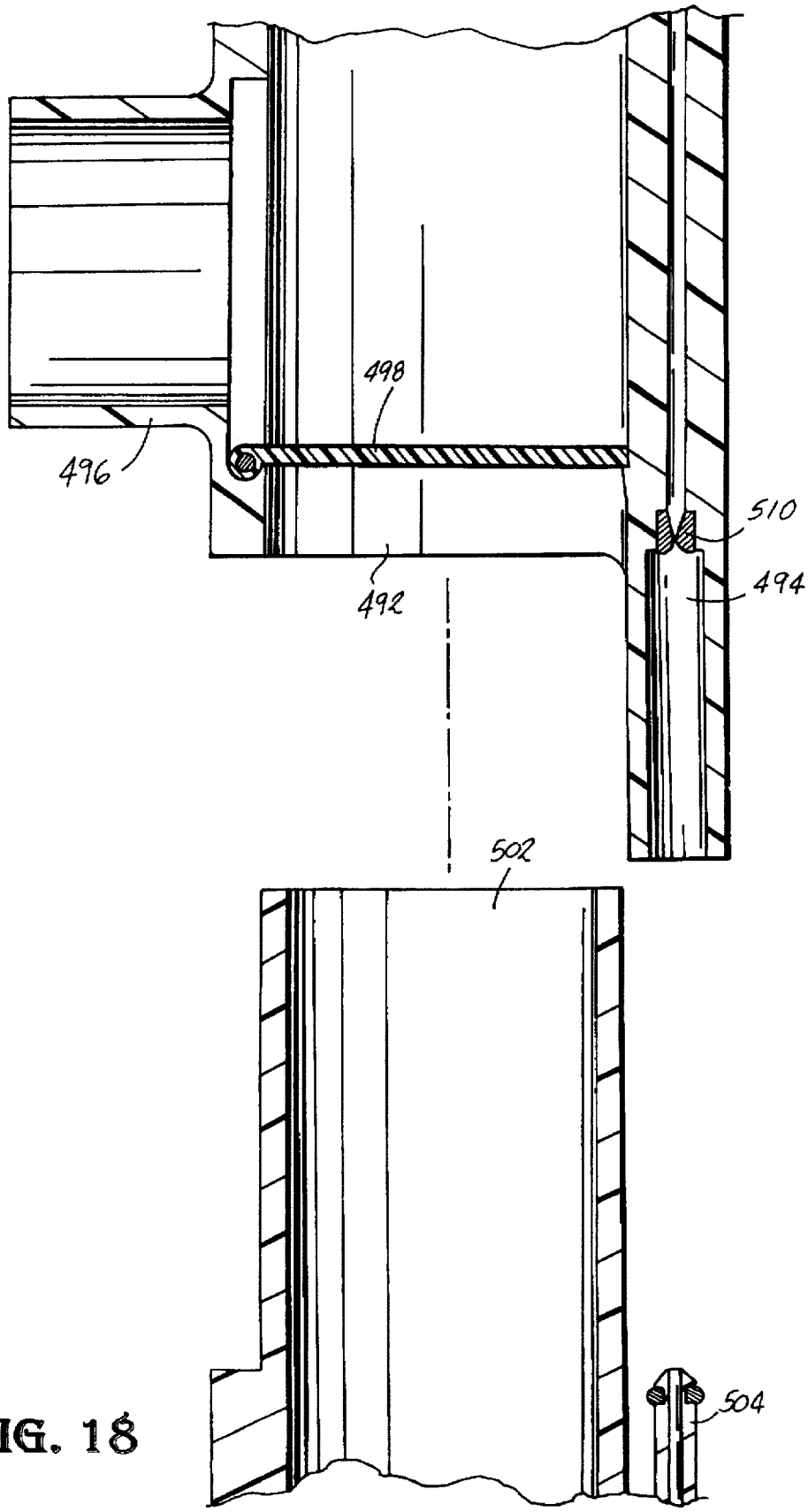
FIG. 18 is a view similar to FIG. 17 showing the cleaning module disconnected from the base.

In operation, the flapper valve 498 is spring biased to the downward position as seen in FIG. 18. In this position, the cleaning module 356 is separated from the foot housing 352 and all of the working air flow generated by the vacuum motor fan is directed solely to the hose 460 and associated cleaning tools. Similarly, all of the pressurized solution supplied by the pump is directed to the finger trigger on the terminal end of the accessory hose 460.

Figure 17:
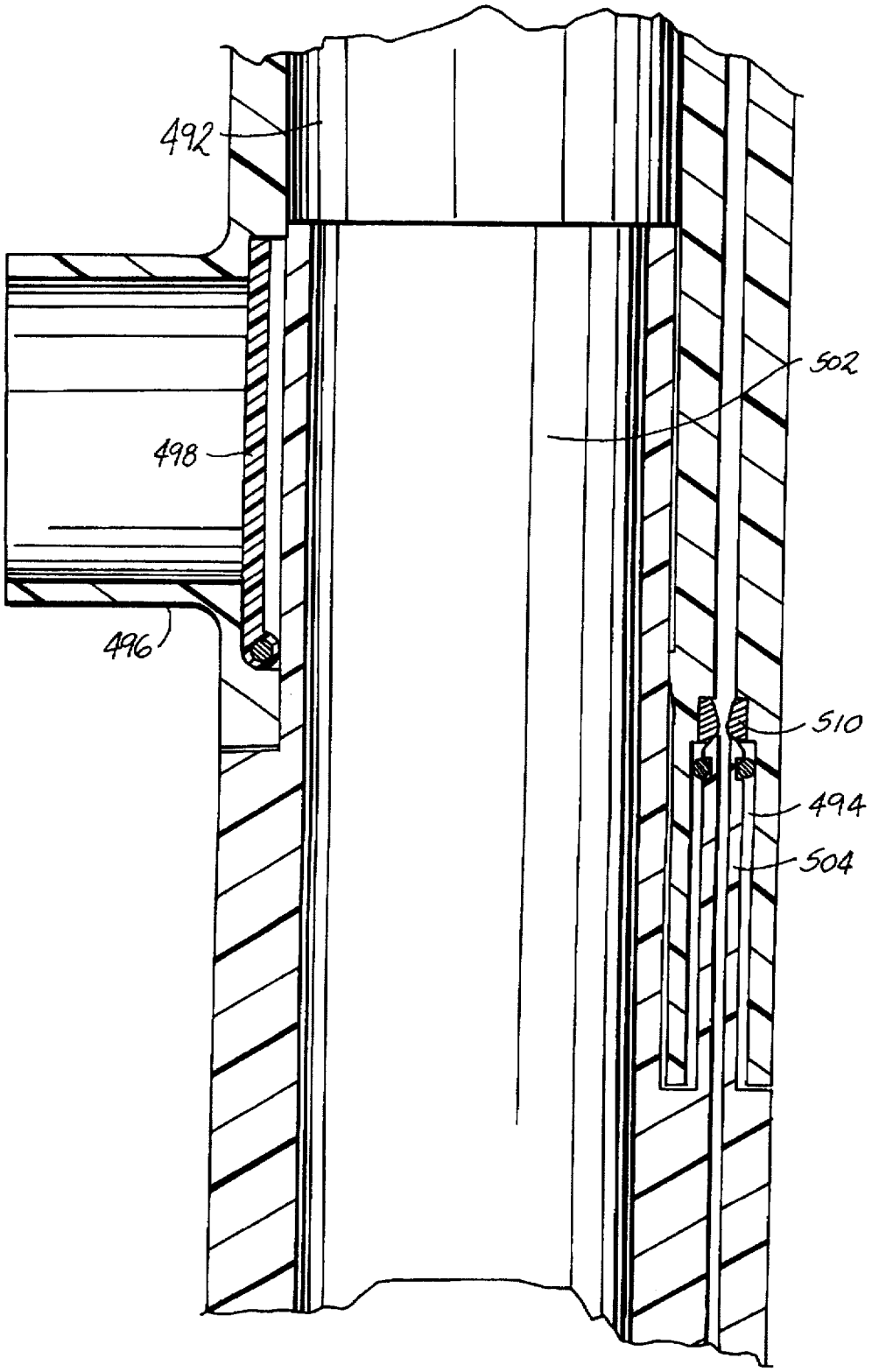
FIG. 17 is a partial, sectional view of a portion of the cleaning machine of FIG. 13 showing the detail of the interconnection between the cleaning module and the base.

When the user desires to mount the cleaning module 356 to the support member 354 and foot housing 352, the cleaning module 356 is lowered into the base pan 358. As the module 356 is lowered into the pan 358, the working air flange 502 and solution conduit flange 504 of the foot housing 352 are received in the corresponding working air conduit 492 and solution conduit 494 of the cleaning module 356. As the working air flange 502 enters the working air conduit 492, the flange contacts the flapper valve 498 and eventually pivots the valve 498 to a second position, as seen in FIGS. 16 and 17. In this position, the flapper valve 498 effectively seals the air flow through the hose mounting boss 496 to the hose 460 thereby directing all of the vacuum produced by the vacuum motor solely to the flexible hose 506 and suction nozzle opening 374. Simultaneously, the solution conduit flange 504 is received in the solution conduit 494 and opens the valve 510 to establish fluid communication between the pump and the spray bar 386. The trigger 406 provided on the hand grip 404, in cooperation with the push rod 407 and valve 409, is adapted to control the distribution of cleaning solution through the spray bar 386 when the cleaning module 356 is mounted to the foot housing 352 and support member 354.

Simultaneous with the establishment of the vacuum air flow and solution connections, the cleaning module 356 is electrically connected to the foot housing 352 through the interconnections oft he male and female electrical connectors 408, 410. When this connection has been established, electrical current necessary for operating the agitation brush motor 376 is conducted from the module 356 to the foot housing 352.

The cleaning module 356 can be quickly and easily removed from the foot housing 352 and elongated support member 354 for use at an unlimited distance from these elements by merely lifting, vertically, on the handle 436 to separate the module 356 from these elements. Upon removal of the working air flange 502 from the conversion valve housing 490, the biased flapper valve 498 will pivot downwardly to the first position as seen in FIG. 18 so that all air flow is redirected to the accessory hose 460. Simultaneously, the cheek valve 510 and the solution conduit 494 will close so that all pressurized solution generated by the pump will be directed solely to the cleaning tools provided at the end of the accessory hose 460. Any number of conventional cleaning tools can be mounted to the end of the accessory hose such as a triangular-shaped upholstery tool with brush and spray nozzle. Alternatively, a crevice tool or window washing tool can be attached thereto.

Similar to the first embodiment, the second embodiment for the cleaning machine provides a cleaning module which is selectively mounted to a pivoting handle and base for conventional on-the-floor cleaning or can be quickly and easily removed therefrom for a wide variety of cleaning processes and applications. All of this is accomplished with a minimum amount of effort by the user.

A multi-use cleaning machine according to the invention provides an unlimited number of applications for what appears to be a conventional upright cleaner. The module is compact and lightweight thereby simplifying the use of the module.

While particular embodiments of the invention have been shown, it will be understood, of course, that the invention is not limited thereto since modifications may be made by those skilled in the art, particularly in light of the foregoing teachings. Reasonable variation and modification are possible within the scope of the foregoing disclosure of the invention without departing from the spirit of the invention.

The embodiments of the invention in which an exclusive property or privilege is claimed are defined as follows:

1. A cleaning machine comprising:

a foot housing having a suction nozzle conduit provided therein, the conduit terminating at one end at a suction nozzle opening and a first electrical connector;

an elongated support member pivotally mounted to the foot housing, the elongated support member being adapted for use in pushing and pulling the foot housing along the floor;

a portable cleaning module comprising;

a module housing;

a motor-driven fan supported in the module housing, the fan adapted to generate a working air flow;

a dirt receptacle supported in the module housing for collecting dirt, the receptacle being fluidly connected to the motor-driven fan;

a module conduit fluidly connected to the dirt receptacle and motor driven fan and selectively, fluidly connected to the foot housing suction nozzle for conveying the collected dust and dirt to the dirt receptacle; and a second electrical connector provided on the module housing, the first and second electrical connectors being selectively engaged to create a closed electrical circuit between the foot housing and the module housing;

the module being selectively and removably mounted to one of the elongated support member and foot housing at least through a mechanical interconnection so that the module can be separated from said one of the foot housing and elongated support member and operated independently and separately therefrom as a portable cleaning machine, or can be operated as an upright cleaning machine when the module is mounted to said one of the elongated support member and foot housing.

2. A cleaning machine according to claim 1 wherein the cleaning machine comprises a vacuum cleaning machine.

3. A cleaning machine according to claim 2 wherein the cleaning machine comprises a water extraction cleaning machine.

4. A cleaning machine according to claim 3 wherein the portable cleaning module further comprises:

a clean solution receptacle supported in the module housing, and the clean receptacle is adapted to store a cleaning fluid used in a water extraction cleaning process; and a pump fluidly connected to the clean solution receptacle and adapted to draw the cleaning fluid therefrom; and a solution conduit fluidly connected to the pump and adapted to selectively discharge cleaning fluid therefrom onto a surface to be cleaned.

5. A cleaning machine according to claim 4 and further comprising a cleaning tool fluidly connected to the working air conduit of the module.

6. A cleaning machine according to claim 5 and further comprising a spray nozzle mounted to the cleaning tool, the spray nozzle being fluidly connected to the solution conduit and adapted to selectively deposit cleaning solution onto a surface to be cleaned.

7. A cleaning machine according to claim 1 wherein the foot housing further comprises:

an agitation member rotatably mounted therein; and an agitation member motor adapted to rotate the agitation member, the second electrical connector being electrically connected to the agitation member motor so that a closed electrical circuit is created between the source of electricity and the motor when the module is mounted to the foot housing in the operative position.

8. A cleaning machine according to claim 1 wherein the motor-driven fan is mounted intermediate the working air conduit and the dirty water receptacle.

9. A cleaning machine according to claim 1 and further comprising:

an accessory cleaning hose having a proximal end mounted to the module housing and a distal end being adapted to receive a cleaning tool, the accessory cleaning hose being fluidly connected to the module conduit; and a working air valve member mounted in the module conduit, the working air valve member being moveable between first and second positions; in the first position, the valve member substantially blocks fluid communication between the motor-driven fan and the accessory hose and in the second position, the valve member substantially blocks fluid communication between the motor-driven fan and the foot housing suction nozzle opening.

10. A cleaning machine according to claim 9 wherein the working air valve member is biased into the second position.

11. A cleaning machine according to claim 9 wherein the working air valve member comprises a flapper valve pivotally mounted in the module conduit.

12. A cleaning machine according to claim 9 and further comprising:

a solution distribution member provided in the foot housing and fluidly connected to the pump by the solution conduit, the solution distribution member being adapted to selectively direct cleaning fluid onto the surface to be cleaned;

a solution distribution member provided on the cleaning tool, the solution distribution member being fluidly connected to the pump by the solution conduit and being adapted to selectively direct cleaning fluid onto the surface to be cleaned;

a solution valve member provided in the solution conduit, the solution valve member being moveable between first and second positions; in the first position, the solution valve member substantially blocks fluid communication between the pump and the cleaning tool solution distribution member and in the second position, the valve member substantially blocks fluid communication between the solution pump and the solution distribution member of the foot housing.

13. A cleaning machine according to claim 12 wherein the solution valve member and the working air valve member are integrated into a single conversion valve housing provided on the module housing.

14. A cleaning machine according to claim 13 wherein the foot housing includes a working air actuator provided thereon, the actuator being adapted to bias the working air valve member to the first position when the module is mounted to the foot housing.

15. A cleaning machine according to claim 14 wherein the foot housing includes a solution actuator provided thereon, the solution actuator being adapted to bias the solution valve member to the first position when the module is mounted to the foot housing.

16. A water extraction cleaning machine comprising:

a foot housing having a suction nozzle conduit provided therein, the conduit terminating at one end at a suction nozzle opening;

an elongated support member pivotally mounted to the foot housing, the support member being adapted for use in pushing and pulling the cleaning machine along a surface to be cleaned; and a portable cleaning module selectively mounted to one of the foot housing and the elongated support member, the cleaning module comprising:

a module housing;

a motor-driven fan supported in the module housing for generating a working air flow;

a dirty water receptacle supported in the module housing for collecting dirt and dust, the dirty water receptacle being fluidly connected to the motor-driven fan and having an air/water separator member adapted to separate the working air from entrained water and dirt;

a working air conduit provided in the housing and fluidly connected to the vacuum motor and the dirty water receptacle;

an accessory hose having a proximal end mounted to the module housing and the distal end being adapted to receive a cleaning tool, the accessory hose being fluidly connected to the working air conduit;

a clean solution receptacle supported in the module housing, the clean solution receptacle being adapted to store a cleaning fluid used in a water extraction cleaning process;

a pump fluidly connected to the clean solution receptacle and adapted to draw the cleaning fluid therefrom; and a solution conduit fluidly connected to the pump and adapted to selectively discharge cleaning fluid therefrom onto a surface to be cleaned;

wherein the portable cleaning module can be mounted to one of the foot housing and elongated support member for use as an upright water extraction cleaner, or the module can be removed from the foot housing and the support member for use as a portable water extraction cleaner in a variety of applications.

17. A water extraction cleaning machine according to claim 16 wherein the vacuum motor fan is mounted intermediate the working air conduit and the dirty water receptacle.

18. A water extraction cleaning machine according to claim 16 and further comprising a working air valve member mounted in the working air conduit, the working air valve member being moveable between first and second positions; in the first position, the valve member substantially blocks fluid communication between the motor-driven fan and the accessory hose and in the second position, the valve member substantially blocks fluid communication between the motor-driven fan and the floor suction nozzle opening.

19. A water extraction cleaning machine according to claim 18 wherein the working air valve member is biased into the second position.

20. A water extraction cleaning machine according to claim 18 wherein the working air valve member comprises a flapper valve pivotally mounted in the working air conduit.

21. A water extraction cleaning machine according to claim 18 and further comprising:

a solution member provided in the foot housing and fluidly connected to the pump by the solution conduit, the solution member being adapted to selectively direct cleaning fluid onto the surface to be cleaned;

a cleaning tool mounted to the distal end of the accessory hose, the tool including a solution member which is fluidly connected to the pump by the solution conduit, the solution member being adapted to selectively direct cleaning fluid onto the surface to be cleaned;

a solution valve member provided in the solution conduit, the solution valve member being moveable between first and second positions; in the first position, the solution valve member substantially blocks fluid communication between the pump and the cleaning tool and in the second position, the valve member substantially blocks fluid communication between the solution pump and the solution member of the foot housing.

22. A water extraction cleaning machine according to claim 21 wherein the solution valve member and the working air valve member are integrated into a single conversion valve housing provided on the module housing.

23. A water extraction cleaning machine according to claim 22 wherein the foot housing includes a working air actuator provided thereon, the actuator being adapted to bias the working air valve member to the first position when the module is mounted to the foot housing.

24. A water extraction cleaning machine according to claim 23 wherein the foot housing includes a solution actuator provided thereon, the solution actuator being adapted to bias the solution valve member to the first position when the module is mounted to the foot housing.

25. A water extraction cleaning machine according to claim 16 and further comprising:

a solution member provided in the foot housing and fluidly connected to the pump by the solution conduit, the solution member being adapted to selectively direct cleaning fluid onto the surface to be cleaned;

a cleaning tool mounted to the distal end of the accessory hose, the tool including a solution member which is fluidly connected to the pump by the solution conduit, the solution member being adapted to selectively direct cleaning fluid onto the surface to be cleaned; and a solution valve member provided in the solution conduit, the solution valve member being moveable between first and second positions; in the first position, the solution valve member substantially blocks fluid communication between the pump and the cleaning tool and in the second position, the valve member substantially blocks fluid communication between the solution pump and the solution member of the foot housing.

26. A water extraction cleaning machine according to claim 16 wherein the module housing further comprises a pair of mounting members, each of which are adapted to receive one end of a carrying strap.

27. A water extraction cleaning machine according to claim 16 wherein the module housing comprises a first electrical connector which is electrically connected to a suitable source of electricity, and the foot housing further comprises an agitation member rotatably mounted therein, an agitation member motor adapted to rotate the agitation member, and a second electrical connector which is electrically connected to the agitation member motor, the first and second electrical connectors being adapted to be connected to one another to create a closed electrical circuit between the source of electricity and the motor when the module is mounted to the foot housing in the operative position.

* * * * *